US006382216B1

(12) United States Patent
Clark

(10) Patent No.: US 6,382,216 B1
(45) Date of Patent: May 7, 2002

(54) HANGABLE HAIR BRUSH WITH PICK

(76) Inventor: Wayne Clark, 5001 Industrial Way, Benicia, CA (US) 94510-1033

( * ) Notice: Subject to any disclaimer, the term of this patent is extended or adjusted under 35 U.S.C. 154(b) by 0 days.

(21) Appl. No.: 09/887,931

(22) Filed: Jun. 22, 2001

(51) Int. Cl.[7] ..... A45D 24/00
(52) U.S. Cl. ..... 132/148; 132/149; 132/147
(58) Field of Search ..... 132/148, 150, 132/147, 149, 308, 309, 311, 320; 15/167.1

(56) References Cited

U.S. PATENT DOCUMENTS

| | | | | | |
|---|---|---|---|---|---|
| 922,947 | A | * | 5/1909 | Porter | 132/148 |
| 1,495,675 | A | * | 5/1924 | Colt | 132/311 |
| 1,540,911 | A | * | 6/1925 | Soneshein | 132/148 |
| 1,816,092 | A | * | 7/1931 | Schmitter | 132/309 |
| 2,080,248 | A | * | 5/1937 | Ballou | 132/148 |
| 2,148,927 | A | * | 2/1939 | Conway | 132/148 |
| 2,299,296 | A | * | 10/1942 | Battle | 132/148 |
| 2,413,682 | A | * | 1/1947 | Brown | 132/148 |
| 2,496,311 | A | * | 2/1950 | Renfrew | 132/148 |
| 4,865,481 | A | * | 9/1989 | Scales | 401/195 |
| 5,887,600 | A | * | 3/1999 | Wilk | 132/262 |

* cited by examiner

*Primary Examiner*—John J. Wilson
*Assistant Examiner*—Robyn Kieu Doan
(74) *Attorney, Agent, or Firm*—Joseph L. Strabala, Esq.

(57) ABSTRACT

A hair brush with a body having bristles extending therefrom for brushing hair and a tubular handle connected to the body which handle has a bore disposed normal to its longitudinal axis adjacent to its distal end along with a blind aperture extending from its distal end into the handle, generally along its longitudinal axis; plus a hair pick with a circular opening therein which pick is configured to snugly fit into the blind aperture and so that its opening will register with the bore in the handle. As a result the brush can be conveniently supported on a hook or like device utilizing the bore in the handle while the pick is inserted, and the pick can be easily removed when the brush is in use.

3 Claims, 2 Drawing Sheets

HANGABLE HAIR BRUSH WITH PICK

BACKGROUND OF THE INVENTION

When brushes are used to style the human hair, the bristles of the brush often became matted with loose hairs. It is the practice to use picks to remove the loose hairs from the bristles, which picks are nothing more than an elongated tong with a gripping end that can be slide among the bristles to dislodge the hair entangled in the bristles.

Brushes are often designed with a blind aperture in the distal end of the handle of the brush for retaining a pick so that the user or the brush will readily have a pick available to clean the bristles of hairs matted therein. Since the picks are inserted into the ends of the handles, such handles cannot be equipped with a bore near the distal end of the handles by which the brush can be hung from hooks and the like.

A object of this invention is to provide a brush configuration which includes a pick stored in the end of its handle which also enables the brush to have a transverse bore in the distal end of the handle for hanging the brush on hooks and the like.

SUMMARY OF THE INVENTION

The current invention includes a hair brush having a bristle support with bristles extending from the support for brushing hair, a tubular handle connected to the bristle element, said handle having a bore deposed normal to its longitudinal axis adjacent to its distal end and a blind aperture extending from its distal end into said handle which intersects such bore, and a hair pick sized to be received into such blind aperture, the pick having an oval transverse opening therein which is in registry with such bore of the handle when the pick is fully received in such blind aperture in said handle so there is an opening through the handle for hanging the brush on hooks of the like. Means associated with the pick and blind bore is operable to insure registry of transverse opening in the handle and the pick.

DESCRIPTION OF A PREFERRED EMBODIMENT OF THE INVENTION

Figure 1:
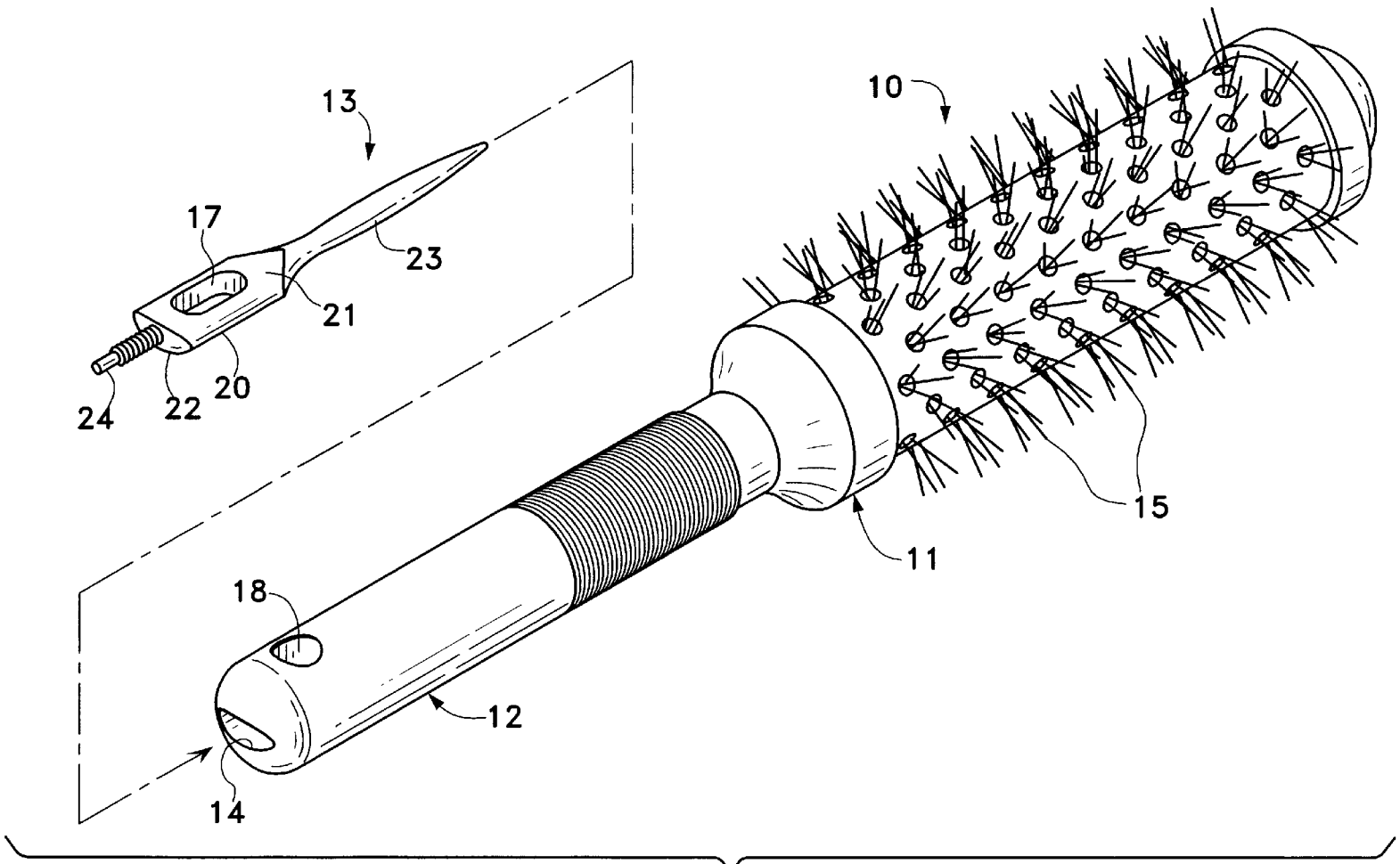
FIG. 1 is perspective of the novel brush and its pick with the latter shown removed from its receptacle in the handle of the brush.

A typical brush 10 employing the novel invention is illustrated in FIG. 1 and includes a brush portion 11 and a cylindrical handle portion 12. While the brush portion and handle portion as illustrated as cylindrical components, other configurations for these components can be used without departing from the spirit of the invention. Cooperating with the handle portion is a pick 12 which is designed so that it can be inserted axially into the end of handle in the aperture 14 of the handle, best illustrated in FIGS. 1 and 2.

There is considerable art illustrating picks which are, for matters of convenience or otherwise, inserted into an aperture formed in the end of handles of such brushes. Such arrangements makes the pick readily available to users of the brush to clean loose hair from the brush which accumulates on the bristles of a brush during use, in the case of the instant invention, bristles 15.

As can be seen in FIGS. 1 through 4 the pick 13 of this invention is oval in cross section as is the aperture 14 in the end of the handle portion 12. The reason for this configuration is so that the pick will register in a precise alignment with the handle when inserted in to the blind bore/aperture 16 formed end of the handle portion 12. The necessity of a precise alignment is so the oblong bore 17 in the pick will register with circular bore 18 in the handle portion, see FIGS. 1, 2 and 3 for a disclosure of this relationship.

With the oblong bore 17 in the pick 13 an increased degree of registry will be achieved with the circular bore 18 of the handle portion 12 when the pick is inserted axially into the distal end 19 of the handle portion of the brush 10.

Figure 2:
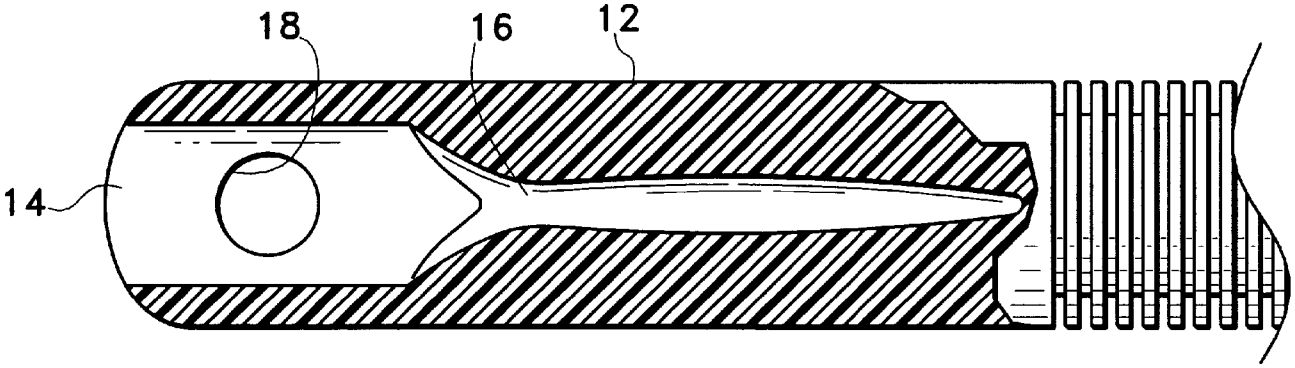
FIG. 2 is an elevation of a broken away portion of the distal end of the handle of the brush shown in FIG. 1 with part there of shown in section to illustrate the aperture therein for the pick.

The axial bore/aperture 16 in the handle portion 12 of the brush 10, best shown in FIG. 2, is formed so that it has a slight interference fit with the pick 13 so that the latter will be maintained in this axial bore when it is inserted therein by the user.

Figure 3:
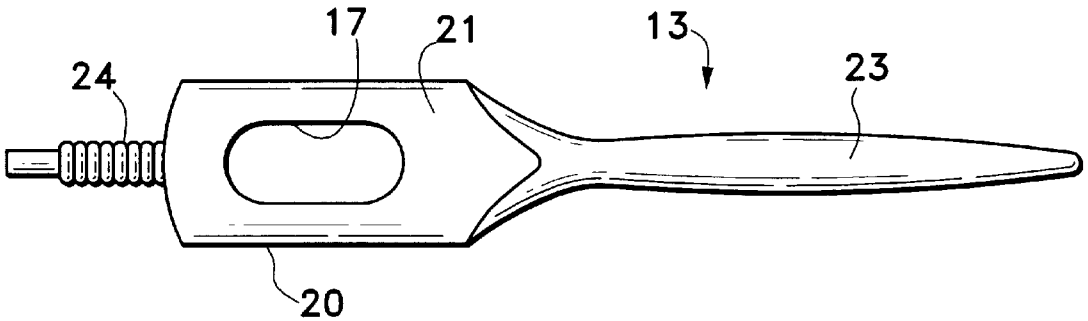
FIG. 3 is a plan view of the pick forming part of the invention.
Figure 4:
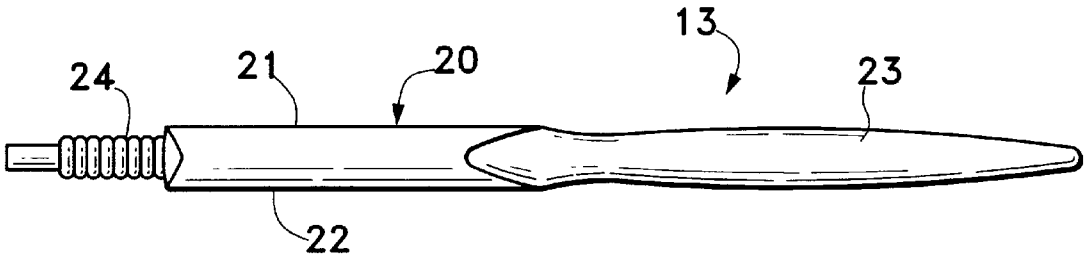
FIG. 4 is an elevation of the pick shown in FIG. 1.

More particularly the configuration of the pick 13 is shown in the preferred embodiment in FIGS. 3 and 4, and has a gripping section 20 which has a flat portion 21 and a curved under side 22 for forming its oval cross section, which section includes a tong 23 extending axially therefrom in one direction and a pin 24 extending therefrom in the opposite direction. The pin projects from the end of the brush when the pick in inserted into the distal end 19 of the handle portion 12 of the brush 10 so that a user can easily remove the pick from the brush when it is needed.

As can be seen from the above description of the novel invention, it allows a brush to be equipped with a pick while still allowing the brush to be hung on hooks or the like utilizing a transverse aperture or bore in the handle of the brush which feature prior art bushes with picks in the handle did not accommodate.

Other embodiments for maintaining registry of the hole in the pick with the bore in the brush handle are within the contemplation of this invention.

Having described my invention, I claim:

1. A brush having a pick in its handle comprising:

a bristle element including a support with bristles extending from said support for brushing hair, a tubular handle connected to the bristle element, said handle having a bore deposed normal to its longitudinal axis adjacent to its distal end and a blind aperture extending from its distal end into said handle intersecting such bore, and a hair pick sized to be received into such blind aperture, said pick having an oval opening therein which is in registry with such bore of said handle when said pick is fully received in such blind aperture in said handle creating a transverse opening through said handle through which said brush can be hung on a hook.

2. The brush as defined in claim 1 wherein means are included in blind aperture operable to to orient the hair pick in such blind aperture when inserted so that its oval opening is as always in registry with such blind bore in said handle when said pick is fully inserted therein.

3. The brush as defined in claim 1 wherein the hair pick has a protruding extension from its distal end for removing it from the blind aperture.

* * * * *